US006831049B1

(12) United States Patent
Torres Moreno

(10) Patent No.: US 6,831,049 B1
(45) Date of Patent: Dec. 14, 2004

(54) ULTRA BRIGHT HEADLIGHT AND TAIL LIGHT CLEANER

(76) Inventor: Juan Pablo Torres Moreno, P.O. Box PMB1027, San Ysidro, CA (US) 92143

( * ) Notice: Subject to any disclaimer, the term of this patent is extended or adjusted under 35 U.S.C. 154(b) by 0 days.

(21) Appl. No.: 10/442,881

(22) Filed: May 21, 2003

(51) Int. Cl.[7] ..... C11D 3/22; C11D 9/04; A46B 13/502; A47K 7/02; B65D 85/84

(52) U.S. Cl. ..... 510/243; 510/180; 15/160; 15/244.1; 206/524.1

(58) Field of Search ..... 510/180, 241, 510/242, 243; 206/524.1; 15/160, 244.1

(56) References Cited

U.S. PATENT DOCUMENTS 4,960,463 A * 10/1990 Brown ..... 106/11

2004/0038423 A1 * 2/2004 Smirnov et al. ..... 436/173

* cited by examiner

*Primary Examiner*—Yogendra N. Gupta
*Assistant Examiner*—John M. Petruncio
(74) *Attorney, Agent, or Firm*—Lisel M. Ferguson, Esq.

(57) ABSTRACT

A cleaning compound and applicator pad for cleansing the covers of headlights and taillights on automobiles. This cleansing compound is substantially non-abrasive and is a composition of kerosene, coco fatty acid diethanol amide, aluminum oxide, ammonia solution, water, white silice and hydrated calcium. The compound is contained upon an applicator pad. The compound and pad are used to remove the opaque yellowish film which result on the surface covering of headlights and taillights which appears after years of accumulating particles of smog, dirt and weathering.

2 Claims, 1 Drawing Sheet

ULTRA BRIGHT HEADLIGHT AND TAIL LIGHT CLEANER

TECHNICAL FIELD

The present invention relates generally to a compound and application apparatus cleaning automobile headlights and taillights. Especially a cleaner for performance of an improved method of clarifying the yellowish opaque coloration which appears on headlights and taillights. This product makes the automobile headlight or taillight bright and clear without the need for excessive scrubbing.

BACKGROUND OF THE INVENTION

There is no automobile cleaning product which is specifically designed to clean headlights and taillights and remove the yellowish opaque film that results after years of accumulating particles of smog, dirt and weathering. The yellowish opaque film which appears affects the clarity of headlights and taillights, it diminishes the light which passes to the exterior and decreases the safety feature of the lights. Cleaning compounds for automobiles and like machines are generally designed to clean the exterior metal paint or glass but do not adequately remove the film which forms on headlights.

Automobile care products are numerous. Most automobile cleaners are designed for the metal paint or glass surface of the automobile. Many of these automobile cleaners require large amounts of scrubbing, and water to wash and rinse. This present invention does not contain most of these hard and abrasive chemicals which have problems associated with their use. This produce is contained on a non-scratch applicator pad which will not scratch the surface covering. These cleaners/polishes of the prior art cause excessive wear to the painted surfaces and fail to adequately clean the yellowish opaque film which develops on the cover of headlights and taillights over the years.

The instant invention is a waterless product which is self-contained on a non-scratch application pad which cleans headlights and taillights and removes the yellowish opaque film that appears after years of use. The instant invention requires very little scrubbing to remove this film restores the headlight to a brand new-like condition with a clear plastic coating and increases the brightness of the headlights and taillights. Most of the patented products as discussed above are waxes or other metal cleaners which make the surface of a vehicle shine, however, do not remove the film which appears on headlights and taillights. For example, U.S. Patent to White U.S. Pat. No. 6,531,440; U.S. Patent to Brown U.S. Pat. No. 5,968,638; U.S. Patent to Trinh U.S. Pat. No. 4,693,840 all disclose auto cleaners which make the surface of the metal shine. There remains a need, however, for an improved compound and method for applying the same which cleans the yellowish opaque film which appears on headlights and taillights and removes this film covering the plastic and causes it to become clear, and increases the amount of light which is yielded from the headlights and taillights. The only currently available products, which are not specifically manufactured for headlights and taillights, but can be used on headlights and taillights, require excessive amounts of scrubbing and result in scratches and abrasions to the surface and do not completely remove this yellow film.

SUMMARY OF THE INVENTION

The instant invention provides a cleaning composition and method which cleans, protects, preserves and enhances the appearance and clarity of the plastic and vinyl surfaces and the like which cover headlights and taillights. This compound has superior coverage and is suitable for both smooth and textured surfaces. It is easy to apply both horizontally and at angled surfaces and does not leave the surface feeling excessively slippery or greasy. This product does not scratch the surface of the headlight or taillight but leaves it clear and enhances the amount of light which is emitted. This compound and applicator can be used on any form of automobile including but not limited to cars, trucks, motorcycles, and Big Rigs.

In one aspect, the present invention provides a cleaning compound which removes the yellowish opaque film which appears on the surface of headlights and taillights due to smog, dirt and weathering. Another aspect of the invention, this compound is self contained on an application pad which can be purchased and used immediately on the headlight or taillight surface. No water or excessive scrubbing is required to clean the headlights or taillights. This compound and application pad can be manufactured in various sizes to be used on automobiles ranging from small cars to large trucks.

The cleaning composition generally includes about 5% kerosene, 10% coco fatty acid diethanol amide, 21% aluminum oxide, 3% ammonia solution, 1% water, and 60% white spirits comprised of 20% of white silice and 80% of hydrate calcium. The cleaning pad on which this compound is held and disbursed from is covered with a fibrous material and contains a base of a sponge-like material.

In another embodiment, the cleaning compound comprises between 2% and 5% of water, between 4% and 5% of ammonia solution, about 18% to 24% ammonium oxide, about 8% to 14% coco fatty diethanol amide, about 4% to 7% kerosene, and about 50% to 70% white spirits. White spirits comprise approximately 15% to 20% white silice and 70% to 85% hydrate calcium.

DETAILED DESCRIPTION

Figure 1:
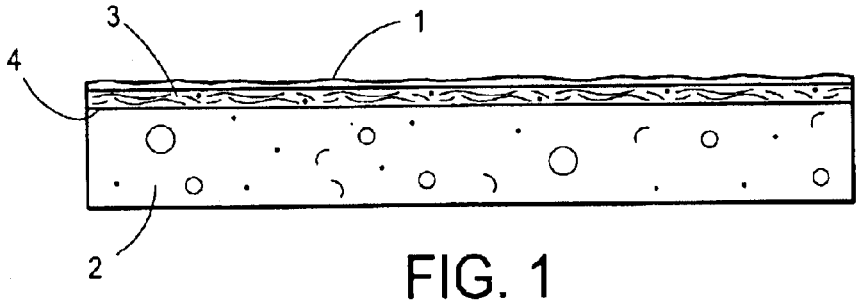
FIG. 1 is a side view of the preferred applicator pad comprising a fibrous upper surface connected to a sponge-like lower portion with a surface area ranging from 800 cm sq. to 3,200 cm sq.
Figure 2:
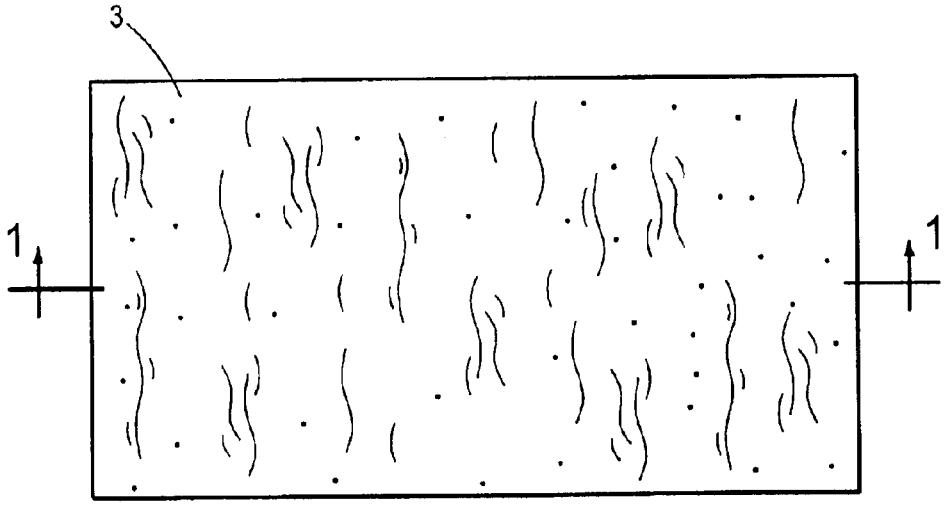
FIG. 2 is a top view of the applicator pad of FIG. 1. The cleansing compound is contained on this surface.
Figure 3:
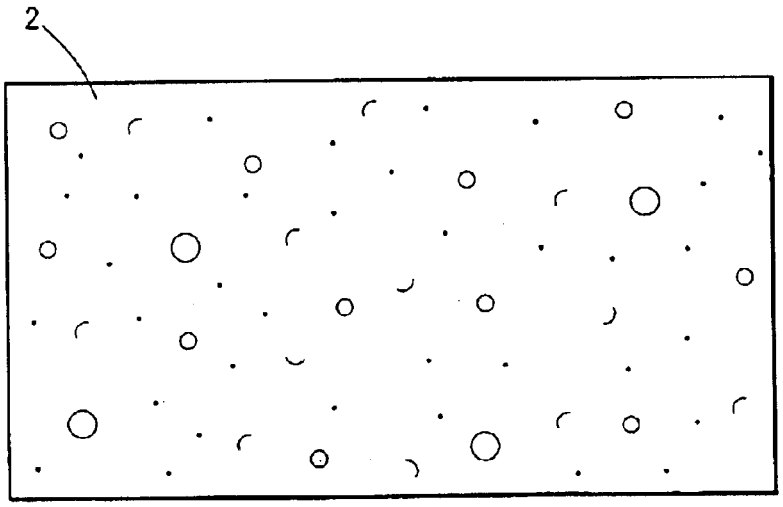
FIG. 3 is a bottom view of the applicator pad of FIG. 1. The lower portion of this pad contains the spongy material for finalizing the application process.

An automobile headlight and taillight cleaning compound which is suitable for cleaning opaque yellowish film off the surface of headlights and taillight covers. The cleansing of these plastic or vinyl covers leads to an increased transmission of the light from both in the headlights and taillights. This compound is contained on a pad with resilient non-abrasive no-scratch fibers on the upper surface (FIG. 1 No. 1) and an absorbent sponge-like underside (FIG. 1 No. 2). The resilient fibers are attached at their base substantially vertical to the sponge underside. (FIG. 1 No. 3). These fibers are 2 to 20 mm in length, have a diameter from 15 to 100 microns, are attached to the base at a density of 250 fibers/$cm^2$ and cover the entire surface of the pad. The cleaning compound contains kerosene, coco fatty acids diethanol amide, aluminum oxide, ammonia solution, water, white silice and hydrated calcium.

Optional components that can be included in this compound include UV absorbers such as benzotriazoles, benzophenones, and the like. The optional components can comprise up to about 10% weight percent of the cleaning compound, however, usually 2% weigh percent.

The compound is applied with the pad to the exterior surface of the headlight and taillight's plastic or vinyl covering. A circular motion may be used to remove the film which has developed on these surfaces. Very little scrubbing is required to remove this film. A thin layer of the cleaning compound is contained on the upper fibrous portion of the cleaning pad. The spongy underside of the cleaning pad can be used to remove any extra compound on the surface of the headlights and taillights.

What is claimed is:

1. A headlight and taillight cleaner comprising of a sponge-like pad containing a predetermined amount of car cleaning compound, said cleaning compound having:

from 3% to 15% by weight of kerosene;

from 8% to 20% by weight of coco fatty acid diethanol amide;

from 17% to 28% by weight of aluminum oxide;

from 1% to 5% by weight of ammonia solution;

from 0.5% to 2% by weight of water;

from 40% to 80% by weight of white spirits which contains from 18% to 22% by weight white silice and from 78% to 82% by weight of hydrated calcium.

2. A headlight and taillight cleaner comprising a sponge like pad as set forth in claim One having resilient fibers and a base, said fibers attached substantially vertically to said base, said fibers being non-abrasive, said fibers having a length from 2 to 20 mm, a diameter from 15 to 100 microns, said fibers being attached to said base at a density of 250 fibers/$cm^2$, said base having a surface area from 800 cm sq. to 3,200 cm sq.

* * * * *